US007510516B2

(12) United States Patent
Zetterstrom et al.

(10) Patent No.: US 7,510,516 B2
(45) Date of Patent: Mar. 31, 2009

(54) PACKAGING DEVICE

(75) Inventors: Hakan Zetterstrom, Eslov (SE); Nick Baker, Malmo (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 10/533,800

(22) PCT Filed: Nov. 24, 2003

(86) PCT No.: PCT/SE03/01819

§ 371 (c)(1),
(2), (4) Date: May 4, 2005

(87) PCT Pub. No.: WO2004/054790

PCT Pub. Date: Jul. 1, 2004

(65) Prior Publication Data

US 2005/0272584 A1 Dec. 8, 2005

(30) Foreign Application Priority Data

Dec. 13, 2002 (SE) ..... 0203690

(51) Int. Cl.
*B31C 1/04* (2006.01)

(52) U.S. Cl. ..... 493/308; 493/108

(58) Field of Classification Search ..... 493/308, 493/454, 164, 165, 309, 310, 108; 53/563, 53/376.6, 565, 568, 452, 458
See application file for complete search history.

(56) References Cited

U.S. PATENT DOCUMENTS 2,047,804 A * 7/1936 Shapiro ..... 229/138
2,091,291 A * 8/1937 Ringler ..... 229/109
3,041,942 A * 7/1962 Repking ..... 493/93
3,389,849 A * 6/1968 Egleston ..... 229/249
3,977,594 A * 8/1976 Swan ..... 299/109
4,375,969 A * 3/1983 Woerz ..... 493/158
4,502,624 A * 3/1985 Burrell ..... 229/109
4,603,535 A * 8/1986 Schultheis ..... 53/374.2
4,702,410 A 10/1987 Derving
4,717,022 A * 1/1988 Combs ..... 206/418
4,730,766 A * 3/1988 Fear ..... 299/137
5,167,607 A * 12/1992 Larsen ..... 493/183

(Continued)

FOREIGN PATENT DOCUMENTS

EP 0 862 980 B1 9/1998

(Continued)

*Primary Examiner*—Sameh H. Tawfik
(74) *Attorney, Agent, or Firm*—Buchanan, Ingersoll & Rooney PC

(57) ABSTRACT

A method of and a device for folding a bottom of a package, which includes a sleeve of packaging material with a transversal seal in the end of the bottom forming portion of the package, the portion having the shape of a fin. The method includes folding the fin and forming primary flaps, breaking corners on the folded fin between the primary flaps and the edge between the part of the sleeve forming the bottom and the rest of the sleeve, such that secondary flaps are folded in between the primary flaps and the fin, the secondary flaps thereby being folded essentially towards each other, folding the primary flaps towards each other, and pressing the primary flaps towards the remaining part of the bottom forming part of the sleeve.

10 Claims, 6 Drawing Sheets

U.S. PATENT DOCUMENTS

| | | | | | |
|---|---|---|---|---|---|
| 5,295,941 | A | * | 3/1994 | Fujikawa et al. | 493/133 |
| 5,324,250 | A | * | 6/1994 | Janson et al. | 493/133 |
| 5,439,166 | A | | 8/1995 | Focke | |
| 5,531,375 | A | | 7/1996 | Palm | |
| 5,533,666 | A | | 7/1996 | Cromwell | |
| 5,628,450 | A | | 5/1997 | Cromwell et al. | |
| 5,678,391 | A | * | 10/1997 | Andersen et al. | 53/477 |
| 6,050,056 | A | * | 4/2000 | Weisser et al. | 53/370.6 |
| 6,094,884 | A | | 8/2000 | Christensen et al. | |
| 6,385,950 | B1 | | 5/2002 | Anderson | |
| 6,626,810 | B1 | * | 9/2003 | Bressler et al. | 493/176 |
| 7,076,931 | B1 | * | 7/2006 | Trani et al. | 53/452 |

FOREIGN PATENT DOCUMENTS

| | | |
|---|---|---|
| EP | 0 960 014 B1 | 12/1999 |
| JP | 7-187181 | 7/1995 |
| JP | 11-91000 | 4/1999 |
| WO | 98/32666 | 7/1998 |

* cited by examiner

PACKAGING DEVICE

This application is the National Phase of International Application PCT/SE2003/001819, filed Nov. 24, 2003, published under PCT Article 21(2) in English as WO 2004/054790 A1. International Application PCT/SE2003/001819 claimed priority to Swedish Application 0203690-3, filed Dec. 13, 2002.

TECHNICAL FIELD OF THE INVENTION

The present invention relates to a method and a device for folding the bottom of a package as well as a package.

BACKGROUND ART

A variety of different packaging solutions are currently used for different types of liquids. The packages, or containers, can be made of e.g. aluminium, plastic or laminated paper. Different packaging materials and different container designs could be appropriate for different types of liquids.

The choice of packaging material is also based on the container design. One type of container which is particularly suitable for non-carbonated beverages consists of a sleeve, a bottom and a top, where the different parts are not necessarily made of the same material. For instance, the sleeve and the bottom can be integrally manufactured of laminated paper and the top be injection moulded in plastic. The bottom is, for instance, formed by sealing one end of the sleeve and then folding it such that a square or rectangular bottom is created. Such a container is disclosed in EP-B1-0 960 014 and WO 98/32666. A similar design is disclosed in EP-A1-0 862 980. Such containers can be used for beverages that are meant to be drunk directly from the container. When holding a container in one's hand, it is often most comfortable if the container is round in cross-section. However, known containers with folded bottoms are square or rectangular in cross-section. To fold the bottom such that the cross-section of the sleeve is essentially round is not feasible using known techniques.

SUMMARY OF THE INVENTION

An object of the present invention is to provide a folding of the bottom of a package such that the package obtains an essentially rounded cross-section.

Thus, according to the method of the invention the bottom of a package is folded, which package comprises a sleeve of packaging material with a transversal seal in the end of the bottom forming portion of the package, said portion having the shape of a fin, using the steps of folding the fin such that primary flaps are created at the transversal ends of the fin, breaking corners on the folded fin in the boundary regions between the primary flaps and the edge between the part of the sleeve forming the bottom and the rest of the sleeve, such that secondary flaps are folded in between the primary flaps and the remaining part of the fin, the secondary flaps on the same primary flap thereby being folded essentially towards each other, folding the primary flaps towards each other, and pressing the primary flaps towards the remaining part of the bottom forming portion of the sleeve.

This folding method has the advantage of being fast and efficient. It affords the package a stable bottom of a shape that gives the rest of the sleeve an essentially rounded cross-section, making it convenient for a consumer to hold. This way of folding the bottom can also be used for the forming of packages having a cross-section formed by two circular halves connected by two essentially parallel straight lines. The distance between the straight lines and the rounded side makes it easy for the consumer to grip the package even containing large volumes.

According to a preferred embodiment of the invention, the bottom of the package is folded into an octagonal shape. This gives the advantage of providing the package with a bottom shape which gives the sleeve a rounded cross-section.

Further, the sleeve can have a longitudinal seal and the fin is preferably then pre-folded away from the longitudinal seal prior to the primary flap-creating folding step.

This gives the advantage of making the rest of the folding easier to perform, since the direction of the folding of the fin is then predetermined. Thus, this ascertains that the fin is not bent in the middle and folded in different directions towards the part of the sleeve forming the bottom. The pre-folding away from the longitudinal seal is the easiest way to fold the fin, since it is then not folded over the double layers of package material in the longitudinal seal.

The fin can be heated during the pre-folding to reduce the risk of any cracks occurring in the packaging material. This increases the safety margin in respect of ensuring that the package contents do not come in contact with the outside of the package or any other layers in the packaging material than the one closest to the contents, which otherwise could lead to a quality deterioration of the contents.

The fin can be heated in a number of locations, where it is arranged to be sealed during the pressing down-step, along its length prior to the pressing-down step. This gives the advantage of providing an easy way of holding the fold together, since the heating melts some of the surface packaging material, which is then sealed to the parts of the fin pressed against it during the pressing-down step.

A first partible external forming tool can retain the package during the pressing-down step. This is advantageous since it adds stability and the pressing down can be performed with greater power, thus ensuring a tight fold.

The first partible external forming tool can be opened and closed along the contours of a parallelogram. This has the advantage of saving space when opening the forming tool. It is also advantageous since it is a fast and convenient way of operating the forming tool, since the opening movement of the tool is utilised to the same extent along the whole height of-the package.

The invention also concerns a device for folding the bottom of a package, which package comprises a sleeve of packaging material with a transversal seal in the bottom in the shape of a fin, which device comprises a first folding unit for folding the fin such that flaps are created at the transversal ends of the fin, a breaking unit for breaking corners on the folded fin in the boundary regions between the primary flaps and the edge between the part of the sleeve forming the bottom and the rest of the sleeve, such that secondary flaps are folded in between the primary flaps and the remaining part of the fin, the secondary flaps on each side of each primary flap thereby being folded essentially towards each other, a second folding unit for folding the flaps against each other, and a pressing unit for pressing the flaps towards the remaining part of the bottom forming part of the sleeve. The device is preferably arranged for folding the bottom into an octagonal shape. This device has the above advantages of the previously described method.

The breaking unit can have four knives arranged in positions essentially at the corners of a rectangle, such that each respective knife is able to operate on a respective side of a respective flap. This has the advantage of making it possible to perform the breaking simultaneously on both sides of both transversal end flaps in a fast and efficient manner.

The sleeve can have a longitudinal seal and the device can comprise means for pre-folding the fin away from the longitudinal seal, and the device can have first means for heating the pre-folded fin and reducing the risk of cracks occurring in the packaging material. The means for pre-folding the fin and the first means for heating the pre-folded fin can be arranged in a first sub-assembly, which gives the advantage of making it possible to perform the pre-folding and heating essentially simultaneously, thereby making it possible for the device to work with a higher efficiency.

At least one first cylinder can be connected to a respective at least one first cam wheel and be arranged to control the movement of the first sub-assembly and members thereof. This gives the advantage of providing an easy and reliable way of controlling the movements.

The device can comprise a first pair of brackets for holding the breaking unit and a second pair of brackets for holding the first folding unit, which brackets each are provided with cam surfaces, wherein one shaft is arranged on each side of the pairs to move along the cam surface on each side of the pairs and thereby simultaneously control the movement of the breaking unit and the first folding unit. This gives the advantage of providing a simple way of controlling the movement of the two units and ensuring that they are moved in the desired way in relation to each other as well as the package. It also makes the construction of the device more simple since the two units can be driven and controlled by a common drive unit to which the shafts are connected.

The device can comprise at least one flap support which is arranged to flatten the primary flaps against the folding unit. This gives the advantage of ensuring an attractive appearance of the final folded package bottom.

The device can comprise second means for heating a number of locations on the folded fin along its length, on which locations the fin is arranged to be sealed, to such an extent that a plastic layer present in the packaging material is at least partly melted. This gives the advantage of making it easy to obtain an efficient sealing of the folded bottom.

The at least one flap support can be arranged to hold the flaps during the heating. This ensures that the flaps are in the correct position during heating so that it is easy for the second heating means to come close to the fin and heat it in the desired locations.

The breaking unit, the folding unit and the second means for heating the fin can be arranged in a second sub-assembly. This makes it possible to perform these three operations during a very short time interval, and let the units operate on the package during partially overlapping time intervals. This gives the advantage of making the device faster and more efficient.

At least one second cylinder can be connected to a respective at least one second cam wheel and be arranged to control the movement of the second sub-assembly and members thereof. This gives an easy and efficient way of controlling the movements.

The device can comprise a first partible forming tool for supporting the package during the pressing down of the flaps towards the part of the bottom forming part of the sleeve. This adds stability to the package and makes it possible to use a greater power in the pressing unit, which makes the sealing of the folding more secure.

Each part of the first partible forming tool can be arranged to be opened and closed essentially along the contour of a parallelogram. This has the advantage of saving space when opening the forming tool. It is also advantageous since it is a fast and convenient way of operating the forming tool, since the opening movement of the tool is utilised to the same extent along the whole height of the package.

The first partible forming tool, the pressing unit and the second folding unit can be arranged in a third sub-assembly. This has the advantage of making it possible to press down the primary flaps very soon after the folding thereof, thus making the pressing down more secure than if the package would have to be moved before the pressing-down-step.

At least one third cylinder can be connected to a respective at least one third cam wheel and be arranged to control the movement of the third sub-assembly and members thereof. This provides an easy, efficient and reliable way of controlling the movements.

At least one cylinder can be arranged to control the movement of at least one moving part comprised in the device, said at least one cylinder being connected to one end of a respective at least one lever, which lever in turn is fixed in the other end and is arranged to abut against a respective rotating cam wheel, and the movement of which is controlled by the same. This gives the advantage of making it possible to control the movement of the moving part in an simple, efficient and reliable manner.

The at least one cylinder can be arranged to pull the lever towards the centre of the cam wheel. This means that the moving part controlled by the cylinder, when the cam wheel does not push the cylinder, is driven towards a position closer to the package or the other half of the moving part. This also means that the only force pushing the moving parts towards the packages or other halves—or, so to speak, their active positions—is the force of the cylinders, which does not have to be very great to achieve the desired folding steps. This is advantageous in the case where, for instance, some kind of tool such as a screw driver has got caught in the device by mistake. Since the only force exerted on the tool is the force of the cylinders, the tool can relatively easily be removed without disassembling the whole device.

The at least one lever and the at least one cam wheel are arranged to cyclically lift the at least one cylinder. This provides an easy way of controlling the cylinders and, thus, the movement of the moving part/parts connected to the cylinder.

At least two cylinders can be provided, each cylinder being controlled via a respective lever by a respective cam wheel, the at least two cam wheels being arranged on a common rotating cam shaft. This is advantageous since it makes it possible to use one common drive unit to operate all the cam wheels, and thus all the moving parts. This is cost-efficient and makes the device easier to operate and service.

The lever can be arranged to abut against the cam wheel at a point which is located a distance from the fixed end of one third of the distance between the fixed end and the cylinder. This has the effect that a rise in the cam curve of e.g. 1 cm raises the cylinder 2 cm, thus making it possible to use very smooth cam curves on the cam wheel. This is an advantage since it reduces the wear on the cam curves.

The moving parts can comprise at least one of the following:

a first folding unit for folding the fin such that flaps are created at the sides of it, a breaking unit for breaking corners on the folded fin, a second folding unit for folding the flaps against each other, a pressing unit for pressing down the flaps towards the remaining part of the sleeve, means for pre-folding the fin, first means for heating the pre-folded fin, second means for heating the folded fin, a first partible forming tool for supporting the package during the pressing down of the flaps.

The invention further concerns a package comprising a sleeve of packaging material with a longitudinal seal, and a transversal seal in the bottom in the shape of a fin, wherein the bottom is folded such that the fin is folded away from the longitudinal seal, a middle portion of the fin is folded towards the part of the sleeve forming the bottom, and the transversal end portions of the fin are folded towards each other and the middle portion of the fin, wherein in regions between the sides of the transversal end portions of the fin, and the edges between the part of the sleeve forming the bottom and the rest of the sleeve, folds are provided on each side of each transversal end portion and folded towards the fin and the part of the sleeve forming the bottom, in between the transversal end portion and the part of the sleeve forming the bottom, such that the bottom has an essentially octagonal shape. This package has the advantage of an essentially rounded cross-section of the sleeve, due to the octagonal shape of the bottom. This results in a package which is comfortable for a user to hold in his hand while e.g. drinking. The bottom folding is stable and can be produced quickly, which leads to efficient production of the package.

BRIEF DESCRIPTION OF THE DRAWINGS

The invention will be described below with reference to the accompanying drawings, in which.

DETAILED DESCRIPTION OF PREFERRED EMBODIMENTS OF THE INVENTION

Figure 1:
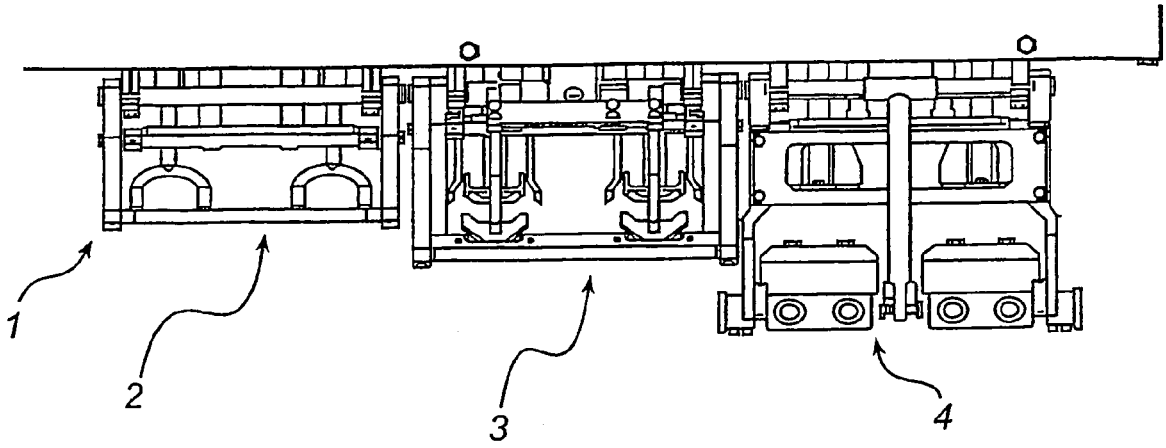
FIG. 1 is a side view of a folding device.

In the following, the operation and different parts of the bottom folding device will be described. The device is shown without any packages, but the packages will have the general shape shown in FIGS. 5*a*-5*d*. The bottom folding device 1 in FIG. 1 contains a first sub-assembly 2, a second sub-assembly 3 and a third sub-assembly 4. According to the shown embodiment of the invention, the folding device 1 is designed to operate on two packages in each unit at a time, i.e. in normal production six packages are located within the folding device. Thus, in the drawings, the different units in the folding device 1 are often shown in pairs of two.

Figure 2B:
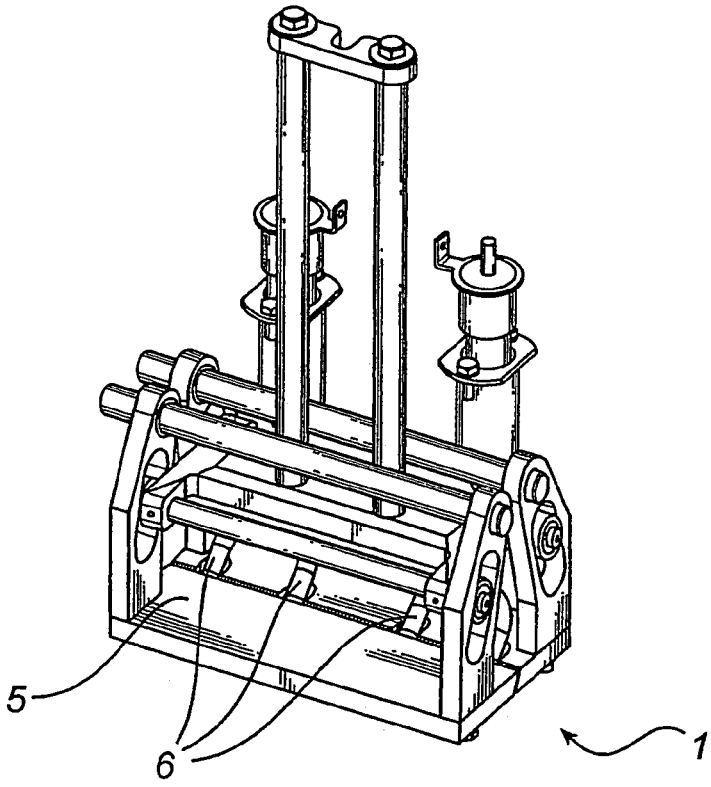
FIG. 2*b* shows the first sub-assembly in a perspective view when closed.
Figure 2A:
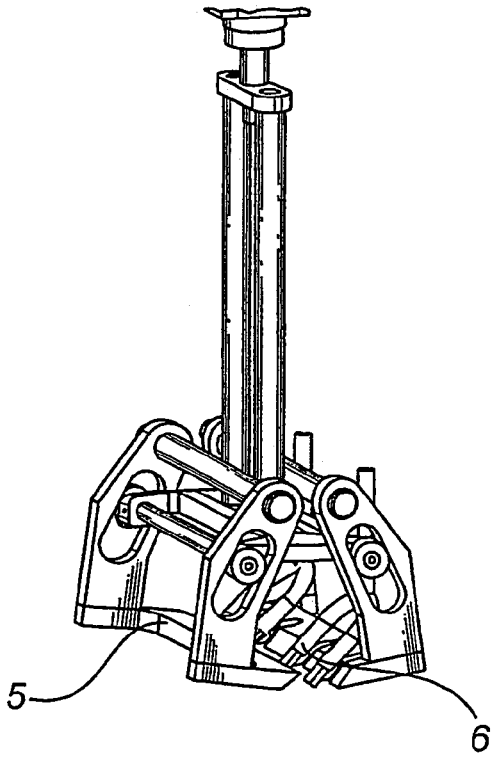
FIG. 2*a* shows the first sub-assembly in a perspective view when open.

The first sub-assembly 2 is shown in FIGS. 2*a* and 2*b*. It comprises a pre-folding unit 5 and a pre-heating unit 6.

Figure 3A:
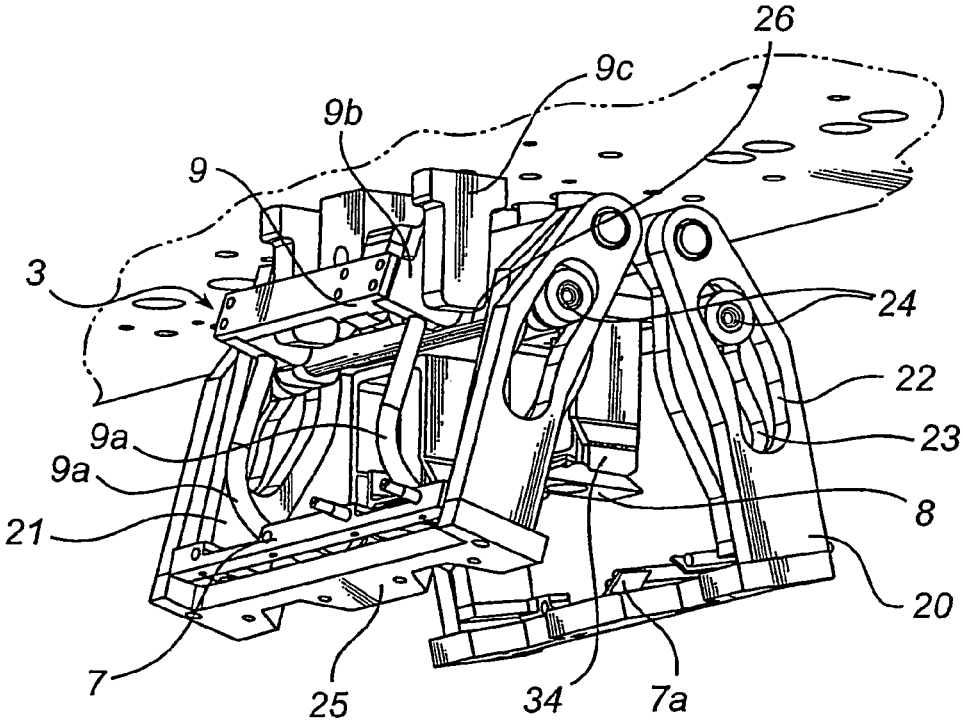
FIG. 3*a* shows the second sub-assembly in a first position in a perspective view.
Figure 3B:
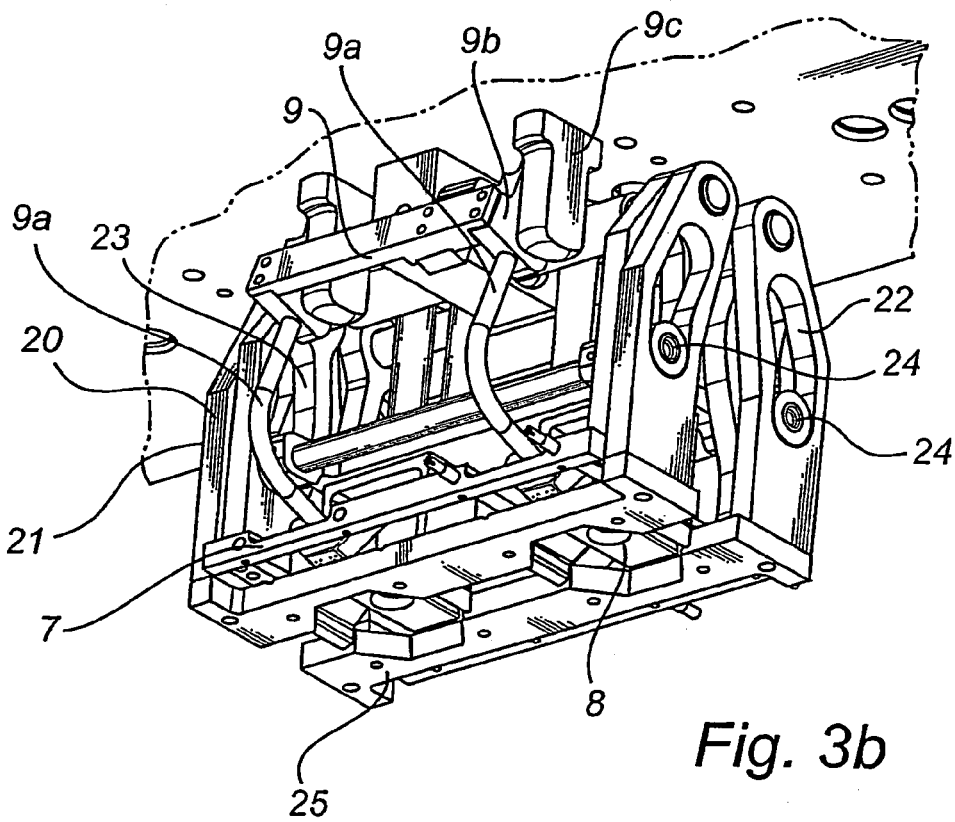
FIG. 3*b* shows the second sub-assembly in a second position in a perspective view when closed.

The second sub-assembly 3 is shown in FIGS. 3*a* and 3*b*. It comprises a breaking unit 7 with knives 7*a*, a first folding unit in the form of a plunger 8, and a heating unit 9 with a nozzle 9*a*, a connection piece 9*b* and a supply piece 9*c*. In FIGS. 3*a* and 3*b* brackets 20 and 21 are also visible which have cam grooves 22 and 23, respectively. Shafts 24 are provided on each side of the brackets. A partible forming tool 25, flap supports 34 and a plate 26 are also provided.

Figure 4A:
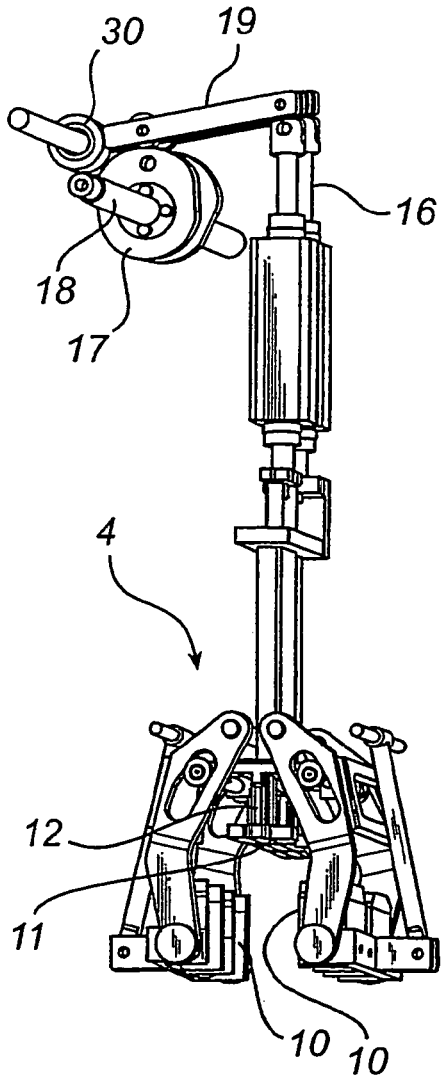
FIG. 4*a* shows the third sub-assembly in a perspective view when open.
Figure 4B:
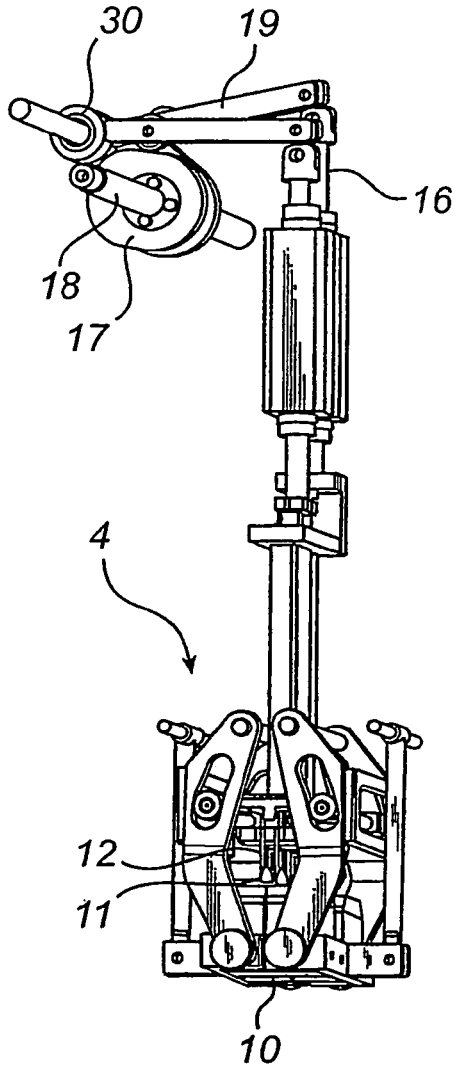
FIG. 4*b* shows the third sub-assembly in a perspective view when closed.

The third sub-assembly 4 is shown in FIGS. 4*a* and 4*b*. It comprises a partible forming tool 10, a pressing unit in the form of a plunger 11 and a second folding unit in the form of ploughs 12. In FIGS. 4*a* and 4*b* a cylinder 16, a cam disc 17, a cam shaft 18 and a lever 19 are also shown.

Figure 5A:
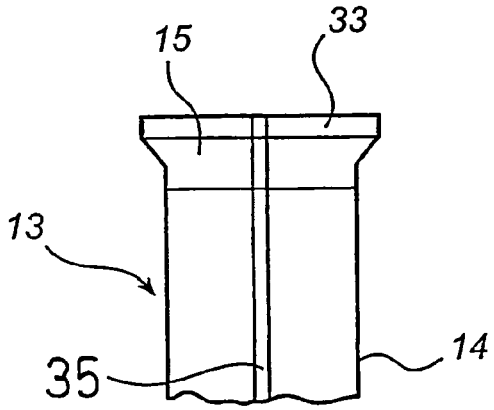
FIG. 5*a* shows a part of the package which is to be folded from one side.
Figure 5B:
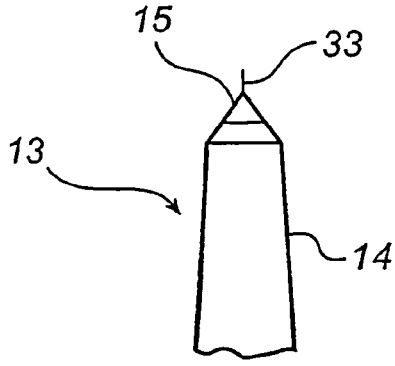
FIG. 5*b* shows a part of the package which is to be folded from another side.
Figure 5D:
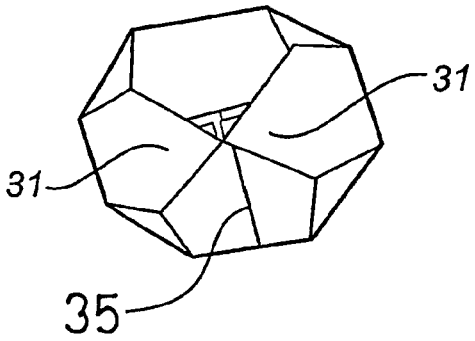
FIG. 5*d* shows the package in a plan view from the bottom when the bottom is folded.
Figure 5C:
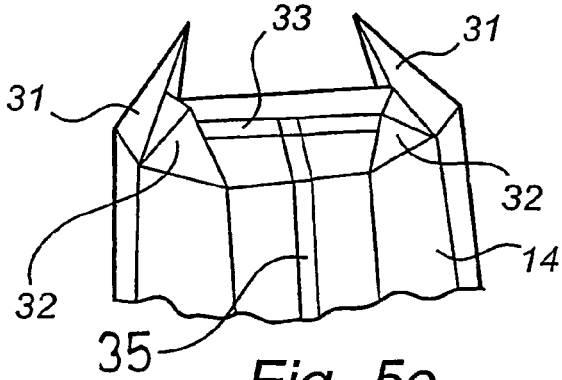
FIG. 5*c* shows the package in a perspective view with the bottom folding portion partly folded.

FIGS. 5*a* and 5*b* show the shape of a package 13 which is to be folded. The package 13 comprises a sleeve 14 with a fin 15 with a transversal seal 33 at its one end. The package 13 also has a longitudinal seal 35. FIG. 5*c* shows the package with the bottom in a partly folded state. The package 13 has primary flaps 31 and secondary flaps 32. FIG. 5*d* shows the folded bottom of the package.

When in operation, packages 13 are fed into the bottom folding device 1 from the left side in FIG. 1 on some sort of conveyor belt (not shown). The packages 13 are arranged "upside down" on the conveyor belt, i.e. standing on their top end on the belt, and may already be filled with the desired contents, in which case they have a top closure, e.g. a plastic top. At their other, bottom end, oriented upwards and facing the bottom folding device 1, the packages 13 are sealed with a transversal seal 33. Thus, the packages 13 are sealed at the bottom end and possibly also filled. The transversal seal 33 forms a fin 15 together with a predetermined portion of the sleeve.

The material of the packages 13 can, for instance, be laminated paper in one or more layers and an aluminium layer can also be provided. A common material structure comprises from inside out of the package: an innermost layer of a plastic material, an aluminium layer (so-called barrier layer), a paperboard layer and an outer-most layer of a plastic material. The aluminium barrier could, of course, be omitted or replaced by other barrier materials. Moreover, the paperboard layer can also be replaced by other layers of e.g. a polymer giving the package the required stiffness.

In FIG. 2*a*, the first sub-assembly is shown in an open position, and in FIG. 2*b* in a closed position. In the first sub-assembly 2, a pre-folding is performed using a pre-folding unit 5. This unit pre-folds the fin 15 slightly away from the longitudinal seal 35. While pre-folding the fin 15, the pre-heating unit 6 heats the fin 15 where it is folded using e.g. hot air nozzles. This heating makes the layers in the packaging material more flexible and thereby makes it possible to stretch the material during the pre-folding without any cracks occurring in the layers. It is especially important in case of aseptic packages that the aluminum layer not be damaged to such an extent that the aseptic nature of the package is compromised.

Pre-folding the fin 15 in a direction away from the longitudinal seal 35 is preferred, but not necessary, since it is more difficult to fold over the longitudinal seal 22 where a number of layers of packaging material lie one above the other to make the seal reliable.

Subsequently, the package 13 (or packages, as in the shown example) is transported to the second sub-assembly 3 in which the fin 15 is folded, corners are broken, and the fin 15 is heated in a number of locations. The package 13 is held by the forming tool 25 and the lower portion of the flap supports 34 during these operations. The forming tool 25 and the flap supports 34 together define an octagonal package shape.

A middle portion of the pre-folded fin 15 is pressed down against the part of the package 13 forming the bottom using a plunger 8. This operation creates a primary flap 31 on each of the two transversal ends of the fin 15. The upper portions of the flap supports 34, which are mounted on the plate 26, flatten the flaps 31 against the plunger 8 when in their lowest position. To make the final folded package bottom look attractive it is important for the flaps 31 to be flat. On each side of each primary flap 31, in the region between the top end of the flap 31 and the edges between the part of the sleeve forming the bottom and the rest of the sleeve, the breaking unit 7 acts on the package.

The breaking unit 7 comprises four knives 7*a* acting on each package, which knives 7*a* are pressed against each said region to create a corner or secondary flap 32 in each region. These secondary flaps 32 are folded in between the top end of each respective primary flap 31 and the pressed-down middle portion of the fin 15. The package with the primary 31 and the secondary 32 flaps is shown in FIG. 5*c*. The folding of these secondary flaps 32 gives the folded bottom an octagonal shape when the folding operation is finished, as is shown in FIG. 5*d*.

In a number of locations on the fin 15, the packaging material is heated using the hot air nozzles 9*a* of the heating unit 9 which are movable into and out of a position where they heat the fin 15. The heating causes a plastic layer on the surface of the packaging material on these locations to melt. During the heating, the primary flaps 31 are held in position by the flap supports 34 to ascertain that the fin 15 is heated in the correct locations and that the nozzles 9*a* have enough space to be able to come close to the heating locations. It is important that the hot air nozzles 9*a* are close to the desired heating locations during heating since their effect decreases exponentially according to the distance.

Figure 7A:
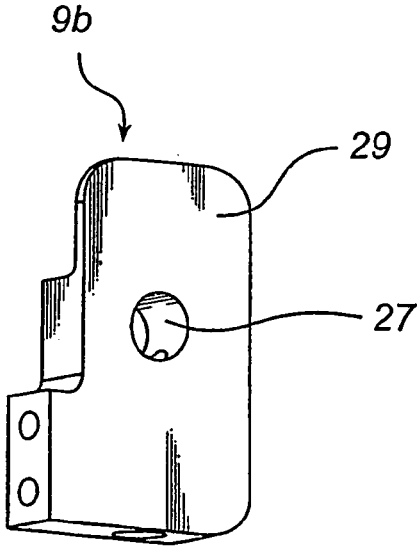
FIG. 7*a* shows a detail of the second sub-assembly on a larger scale.
Figure 7B:
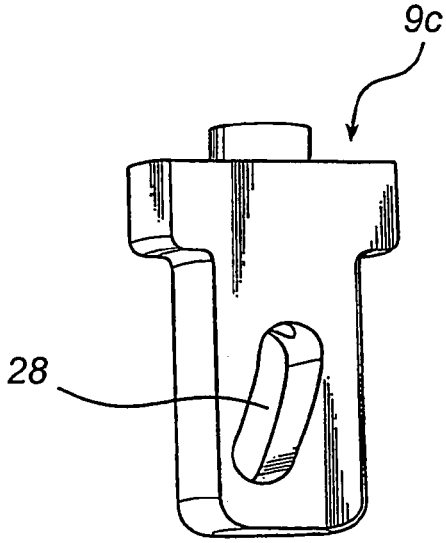
FIG. 7*b* shows another detail of the second sub-assembly on a larger scale.

The hot air is fed to the nozzle 9*a*, via a connection piece 9*b*, shown in FIG. 7*a*, from a supply piece 9*c*, shown in FIG. 7*b*, which is connected to a hot air source (not shown). When the hot air nozzle 9*a* is moved in and out of the position where it heats the fin, the connection piece 9*b* slides against the supply piece 9*c*. The connection between the connection piece 9*b* and the supply piece 9*c* is a sliding swivel connection, in which a hole 27 in the connection piece 9*b* is arranged to slide in an arcuate slot 28 in the supply piece 9*c*. The hot air is fed through the slot 28.

The surface 29 around the hole 27 in the connection piece 9*b* fits tightly against the surface of the supply piece 9*c*, making it impossible for air to leave the slot 28 anywhere else but through the hole 27 in the connection piece 9*b*.

The breaking unit 7 is mounted on a bracket 20 and the forming tool 25 is mounted on a bracket 21. The movement of the brackets is controlled by a pair of shafts 24 on each side of the brackets. The shafts are mounted on a plate 26, and, thus, can only move in two directions, i.e. up and down and not sideways. The ends of the shafts 24 slide in cam grooves 22, 23 on each side of each bracket.

Figure 6A:
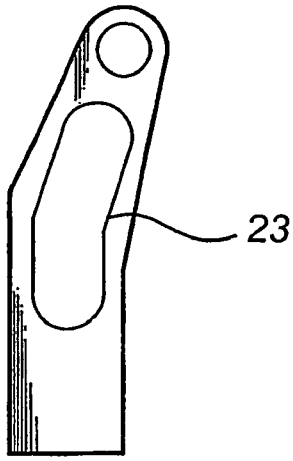
FIG. 6*a* shows a cam profile.
Figure 6B:
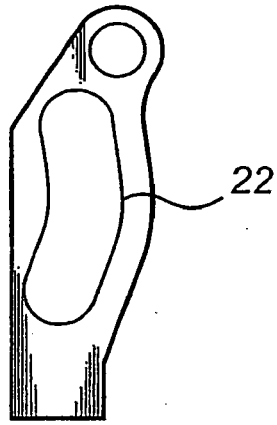
FIG. 6*b* shows another cam profile.

The cam grooves 23 on the forming tool bracket 21 have the shape shown in FIG. 6*a* and the cam grooves 22 on the breaking unit bracket 20 have the shape shown in FIG. 6*b*. Thus, the breaking unit bracket 20 and the forming tool bracket 21 are controlled by the same shafts but move differently since the cam grooves are differently shaped.

The movement of the plunger 8 is separately controlled as is also the movement of the heating unit 9.

The first position for the second sub-assembly is shown in FIG. 3*a*. Here, the plunger 8 is up and the forming tool 25 and the breaking unit 7 are open. In this position the packages 13 whose bottoms are to be folded are indexed into the sub-assembly.

In FIG. 3*b*, the plunger 8 is down and folds the fin to create primary flaps 31 and the knives 7*a* are pressed against the package and fold corners or secondary flaps 32 on each side of each flap 31, in the region between the top end of the flap 31 and the edges between the part of the sleeve 14 forming the bottom and the rest of the sleeve 14. The forming tool 25 retains the package 13 during this operation.

Figure 3C:
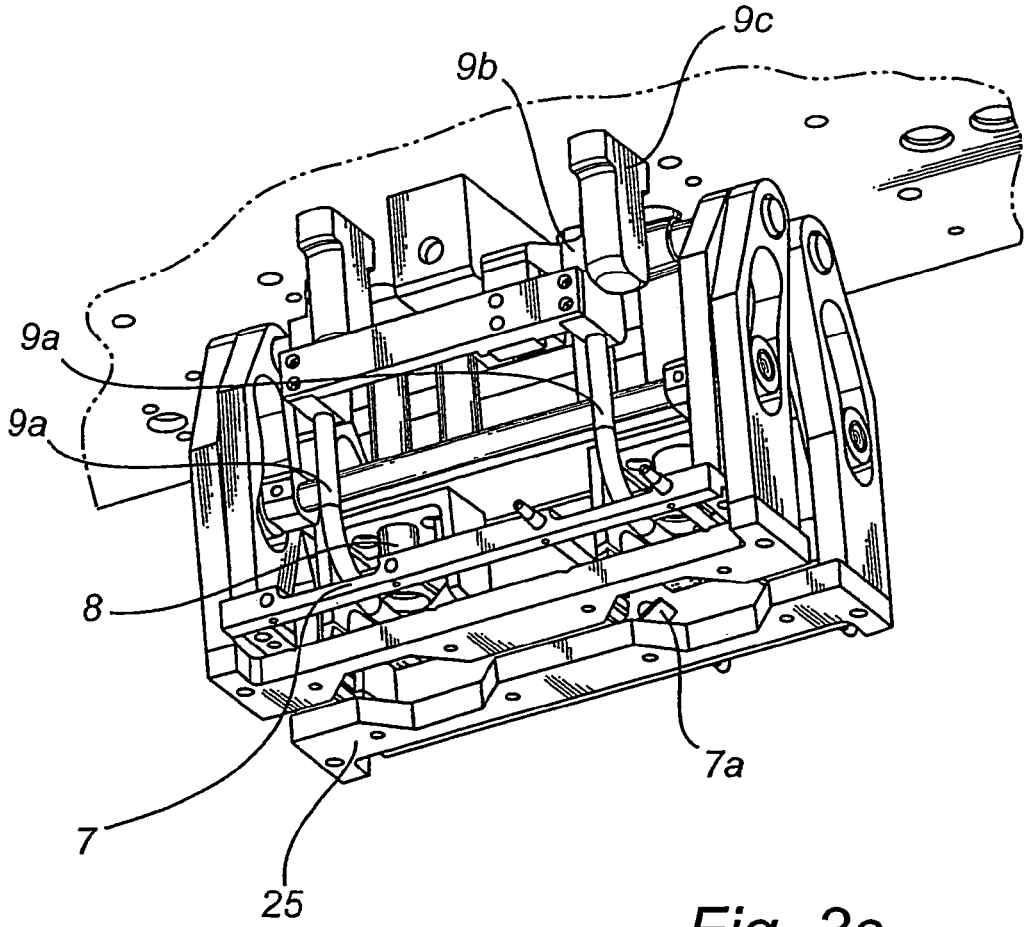
FIG. 3*c* shows the second sub-assembly in a third position in a perspective view.

In FIG. 3*c* the plunger 8 is up and the knives 7*a* are not in contact with the package 13. The heating unit 9 has moved to a position where the hot air nozzles 9*a* act on a number of locations on the folded fin 15 and at least partly melt a plastic layer on the surface of the packaging material on these locations. The forming tool 25 still retains the package 13. Finally the sub-assembly returns to the position shown in FIG. 3*a*.

Subsequently, the packages are indexed to the third sub-assembly 4, where the final folding and sealing of the bottom takes place. In FIG. 4*a* the third sub-assembly is shown in an open position where the forming tools 10 are open and the ploughs 12 and the plunger 11 are up.

When the package 13, having the shape shown in FIG. 5*c*, has arrived to the third sub-assembly 4, the forming tool 10 is closed around the package 13. At the same time the ploughs 12 start to act on the flaps 31 and fold them a bit towards the middle portion of the fin 15. This position of the third sub-assembly 4 is shown in FIG. 4*b*.

Figure 4C:
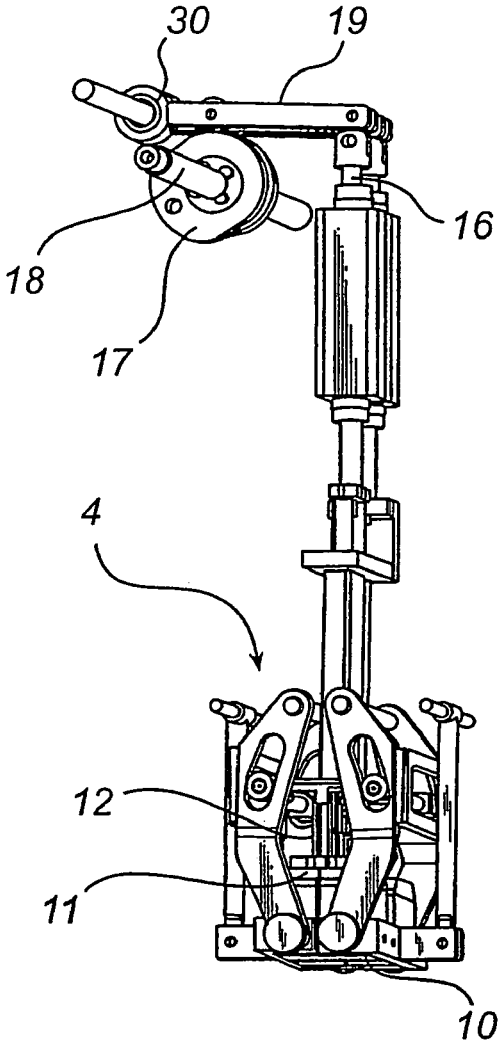
FIG. 4*c* shows the third sub-assembly in a perspective view when closed during pressing-down of the plunger.

In FIG. 4*c* the plunger 11 presses down the flaps 31 completely against the folded middle portion of the fin 15, and, thanks to the previous melting of some locations on the fin, the flaps 31 are then sealed in their folded position against the fin 15. The bottom of the package 13 now has the shape shown in FIG. 5*d*. During the pressing-down of the plunger 11, the ploughs 12 remain in the same place since they are arranged to extend through the plunger 11 and not to be affected by its movement. The plunger 11 remains pressed against the bottom for a time period of about 50 ms to ensure that the sealing is properly performed. After this, the forming tool 10 is opened and the ploughs 12 lifted away from the package. The plunger 11 is also lifted from the folded and sealed bottom and the package 13 is indexed out of the folding device.

In the following, the system for controlling the movement of the different moving parts in the device will be described. Each of the moving parts in the folding device is connected to a respective cylinder 16. Some of the moving parts can be connected to the same cylinder, as is the case with the breaking unit 7 and the forming tool 25.

In FIGS. 4*a* and 4*b* the cylinder 16 is at one end connected to the plunger 11 in the third sub-assembly 4. The description is, of course, applicable to the other moving parts in the device as well.

The cylinder 16 is arranged to always act downwards and, thus, in the shown example to push the plunger 11 downwards. The cylinder 16 is at the other end connected to a lever 19, which in turn is secured to a fixed point 30 at its other end. The end position of the vertical movement of the cylinder can be adjusted by an eccentric bushing (not shown) at the fixed point 30. At a distance from the fixed point 30 of one third of the length of the lever 19, the lever 19 abuts against a rotating cam disc 17. The cam disc 17 is mounted on a cam shaft 18 which controls the rotation of the cam disc 17.

The shape and movement of the cam disc 17 in turn controls the movement of the cylinder 16. When the lever 19 abuts against a part of the cam disc 17 which has a larger diameter, as shown in FIGS. 4*a* and 4*b*, the lever 19 is lifted and in turn lifts the cylinder 16. This in turn raises the moving part connected to the cylinder 16, in this case the plunger 11.

When the lever 19 abuts against a part of the cam disc 17 which has a smaller diameter, as is shown in FIG. 4*c*, the lever 19 is lowered and the cylinder 16 is allowed to push the plunger 11 downwards.

Since the lever 19 abuts against the cam disc 17 at a distance from the fixed point 30 of one third of the total length of the lever 19, a raise in the cam disc 17 by one unit raises the lever end connected to the cylinder 16 by two units. This means that the alterations in the diameter of the cam disc 17 can be small and still effect the desired alterations in the position of the cylinder 16.

When the moving parts are to be moved essentially laterally in and out of contact with the package 13, the vertical movement of the cylinder 16 is converted to at least partly lateral movement via cam grooves in brackets on which the relevant moving part is mounted. An example of this is shown in FIGS. 3*a* and 3*b*, where the vertical movement of the shaft 24 is converted to at least partly lateral movement of the brackets 20 and 21.

The three sub-assemblies operate simultaneously on packages. Also, in the shown embodiment, each of the sub-assemblies are arranged to operate on two packages at the same time, so that the packages are always moved two steps at a time to get to the next sub-assembly. It is of course also possible to use sub-assemblies which are arranged to operate on one, three, four or any number of packages at the same time. Then, the packages are of course moved a corresponding number of steps at a time.

Further, even though the invention has been described in connection with particular embodiments and examples thereof, the scope of the invention should not be limited thereto. Various changes and modification may be made without departing from the scope of the invention, as defined by the appended claims.

The invention claimed is:

1. A method of folding a bottom of a package, which comprises a sleeve of packaging material with a bottom forming portion of the package, said bottom forming portion having the shape of a fin, the method comprising forming a transversal seal at an end of the bottom forming portion whereby the fin comprises a sealed portion of the transversal seal, after the forming of the transversal seal at the end of the bottom forming portion, pressing a middle of the sealed portion of the fin, thereby folding a middle portion of the fin, such that primary flaps are created at transversal ends of the fin, after the pressing of the middle of the sealed portion of the fin, pressing knives against corners on the folded fin in boundary regions between the primary flaps and an edge between the bottom forming portion of the sleeve and the rest of the sleeve, thereby breaking said corners, such that secondary flaps are folded in between the primary flaps and a remaining part of the fin, the secondary flaps on each side of each primary flap thereby being folded essentially towards each other, after the pressing of the knives against the corners on the folded fin, folding the primary flaps towards each other, and pressing the primary flaps towards the folded middle portion of the fin.

2. A method according to claim 1, wherein the bottom of the package is folded into an octagonal shape.

3. A method according to claim 1, wherein the sleeve has a longitudinal seal and the fin is pre-folded away from the longitudinal seal prior to the primary flap-creating folding step.

4. A method according to claim 3, wherein the fin is heated during the pre-folding.

5. A method according to claim 1, wherein the fin is heated in a number of locations, where the fin is arranged to be sealed during the pressing step, along its length, prior to the pressing step.

6. A method according to claim 1, wherein a first partible external forming tool retains the package during the pressing step.

7. A method according to claim 6, wherein the first partible external forming tool is opened and closed along the contours of a parallelogram.

8. A method according to claim 1, wherein the sleeve has a circular cross section.

9. A method according to claim 1, wherein the folding of the primary flaps towards each other comprises pressing ploughs against the primary flaps.

10. A method according to claim 9, wherein the pressing of the primary flaps towards the folded middle portion of the fin comprises moving a plunger between the ploughs to press the primary flaps.

* * * * *